US009669563B2

(12) United States Patent
Lee

(10) Patent No.: US 9,669,563 B2
(45) Date of Patent: Jun. 6, 2017

(54) CHAIN SAW WITH TOOL-FREE CHAIN TENSION ADJUSTMENT MECHANISM

(71) Applicant: JENN FENG NEW ENERGY CO., LTD., Ping Chang, Taoyuan County (TW)

(72) Inventor: Chih-Hsing Lee, Ping Chang (TW)

(73) Assignee: JENN FENG NEW ENERGY CO., LTD., Ping Chang (TW)

( * ) Notice: Subject to any disclaimer, the term of this patent is extended or adjusted under 35 U.S.C. 154(b) by 125 days.

(21) Appl. No.: 14/721,700

(22) Filed: May 26, 2015

(65) Prior Publication Data

US 2016/0346953 A1 Dec. 1, 2016

(51) Int. Cl.
*B27B 17/14* (2006.01)
*B27B 17/02* (2006.01)
*B27B 17/08* (2006.01)

(52) U.S. Cl.
CPC ..... *B27B 17/14* (2013.01); *B27B 17/02* (2013.01); *B27B 17/08* (2013.01)

(58) Field of Classification Search
CPC ..... B27B 17/14; B27B 17/02; B27B 17/08; B27B 17/00; Y10T 83/707; Y10T 83/7226; Y10T 83/7239
USPC ..... 30/386, 381
See application file for complete search history.

(56) References Cited

U.S. PATENT DOCUMENTS 3,382,898 A * 5/1968 Walker ..... B27B 17/14 30/382
5,528,835 A * 6/1996 Ra ..... B27B 17/14 30/383
2006/0207111 A1* 9/2006 Sugishita ..... B27B 17/14 30/386
2010/0088905 A1* 4/2010 Pellenc ..... B27B 17/14 30/386

* cited by examiner

*Primary Examiner* — Phong Nguyen
(74) *Attorney, Agent, or Firm* — Rabin & Berdo, P.C.

(57) ABSTRACT

A chain saw includes a wheel and a chain plate exposed to a saw casing, a chain trained over the wheel and the plate, and a driving device for driving the wheel. The plate is formed with an elongated slot. A chain tension adjustment mechanism includes a shielding cover disposed between the casing and the plate; a slide element disposed movably between the plate and the shielding cover, has a protrusion extending through the slot in the plate; and a biasing member biasing against the slide element and the shielding cover so as to push the slide element away from the wheel, wherein, movement of the plate toward the wheel against biasing action of the biasing member results in retraction of the biasing member from its initial shape and pressing the slide element toward the wheel, thereby releasing the chain from the plate and the wheel and vice versa.

16 Claims, 8 Drawing Sheets

CHAIN SAW WITH TOOL-FREE CHAIN TENSION ADJUSTMENT MECHANISM

BACKGROUND OF THE INVENTION

1. Field of the Invention

The present invention relates to a chain saw, more particularly to a chain saw with tool-free chain tension adjustment mechanism.

2. The Prior Arts

A chain saw is a kind of gasoline-powered portable tool, generally used for cutting wood and the like material. A conventional chain saw generally includes a chain with alternately disposed L-shaped cutting edges such that circular rotation of the chain around a longitudinal direction results in movement of the cutting edges against a wood piece. Traditionally, a flat tip screw driver is commonly used for tightening or loosening an adjustment screw so as to move a chain plate upon which the chain is trained thereon in order to achieve the appropriate tension of the chain.

It is inconvenient for the user to adjust the tension of chain with the use of the adjustment screw, since the latter may often get lost or in case when the same is not available nearby the user.

Moreover, in case the chain plate is disposed within the saw casing, it is relatively difficult and time-wasting for the user to align the through holes in the chain plate relative to the screw holes in the saw casing in order to tightening the chain plate securely relative to the saw casing.

SUMMARY OF THE INVENTION

Therefore, the objective of the present invention is to provide a chain saw with tool-free chain tension adjustment mechanism, in which, a chain plate is formed with an elongated slot and a slide element with a lateral protrusion interactively engaging a first end of the slot such that movement of the chain plate against biasing action of the biasing member results in retraction of the biasing member from its initial shape and pressing the slide element, thereby releasing the chain from the chain plate and vice versa.

Another objective of the present invention is to provide a chain saw with tool-free chain tension adjustment mechanism, in which, the protrusion has an inclined face inclined with respect to a slide base to facilitate and guide a first and second partitions and a chain plate smoothly to its initial position, thereby economizing the human labor during assembly of the chain saw.

A chain saw with tool-free chain tension adjustment mechanism of the present invention includes a saw casing, a sprocket wheel and a chain plate exposed to an exterior of the casing, a saw chain trained over the wheel and the chain plate, and a driving device disposed in the saw casing for driving the sprocket wheel, thereby rotating the saw chain around an outer periphery of the chain plate, the chain plate being formed with an elongated slot having a first end distal from the wheel and a second end proximate to the wheel. The chain tension adjustment mechanism includes a shielding cover, a slide element and a biasing member.

The shielding cover is disposed between the saw casing and the chain plate.

The slide element is disposed movably between the chain plate and the shielding cover, has a protrusion extending through the slot in the chain plate so as to prevent untimely disengagement of the chain plate relative to the slide element and the shielding cover.

The biasing member has a first end biasing against the slide element and a second end biasing against the shielding cover so as to push the slide element away from the wheel, thereby abutting the protrusion of the slide element against the first end of the slot in the chain plate and disposing the saw chain under tension between the chain plate and the wheel.

It is noted that movement of the chain plate toward the sprocket wheel against biasing action of the biasing member results in retraction of the biasing member from its initial shape and pressing the slide element toward the sprocket wheel, thereby releasing the chain from the chain plate and the sprocket wheel and vice versa.

Preferably, the slide element includes a slide base having a first end distal from the sprocket wheel and a second end proximate to the sprocket wheel such that the protrusion projects laterally from the slide base adjacent to the first end of the slide base. The protrusion has an inclined face inclined with respect to the slide base proximate to the first end of the slide base. The chain tension adjustment mechanism further includes a first partition and a second partition, wherein the first partition is sandwiched between the chain plate and the slide element, the first partition is formed with a first partition slot permitting extension of the protrusion of the slide element, the first partition slot has a longitudinal length greater than a longitudinal length of the protrusion so as to permit sliding action of the protrusion within the first partition slot. The second partition is disposed exterior of the chain plate away from the shielding cover, thereby sandwiching the chain plate between the second partition and the sliding element, the second partition is formed with a second partition slot permitting extension of the protrusion of the slide element, the second partition slot has a longitudinal length greater than a longitudinal length of the protrusion so as to permit sliding action of the protrusion within the second partition slot.

The distinct feature of the present invention resides in that owing to interactively engagement of the protrusion of the slide element and the first end of the elongated slot in the chain plate, movement of the slide element against biasing action of the biasing member results in tension adjustment of the chain, hence avoiding the usage of a tool. In addition, the protrusion has an inclined face inclined with respect to a slide base to facilitate and guide the first and second partitions and chain plate smoothly to its initial position, thereby economizing the human labor.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENT

Figure 1:
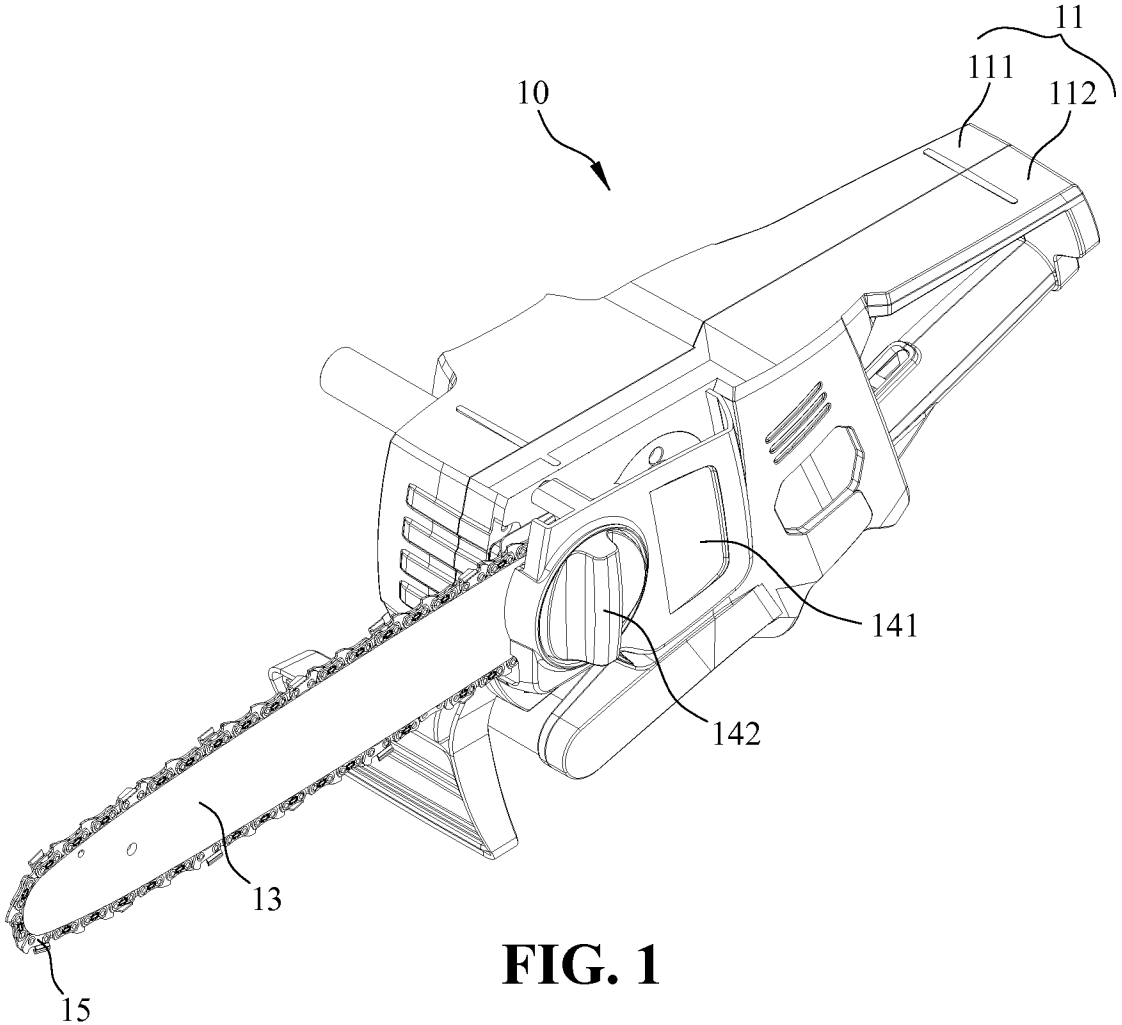
FIG. 1 shows a perspective view of a chain saw with tool-free chain tension adjustment mechanism of the present invention.
Figure 2:
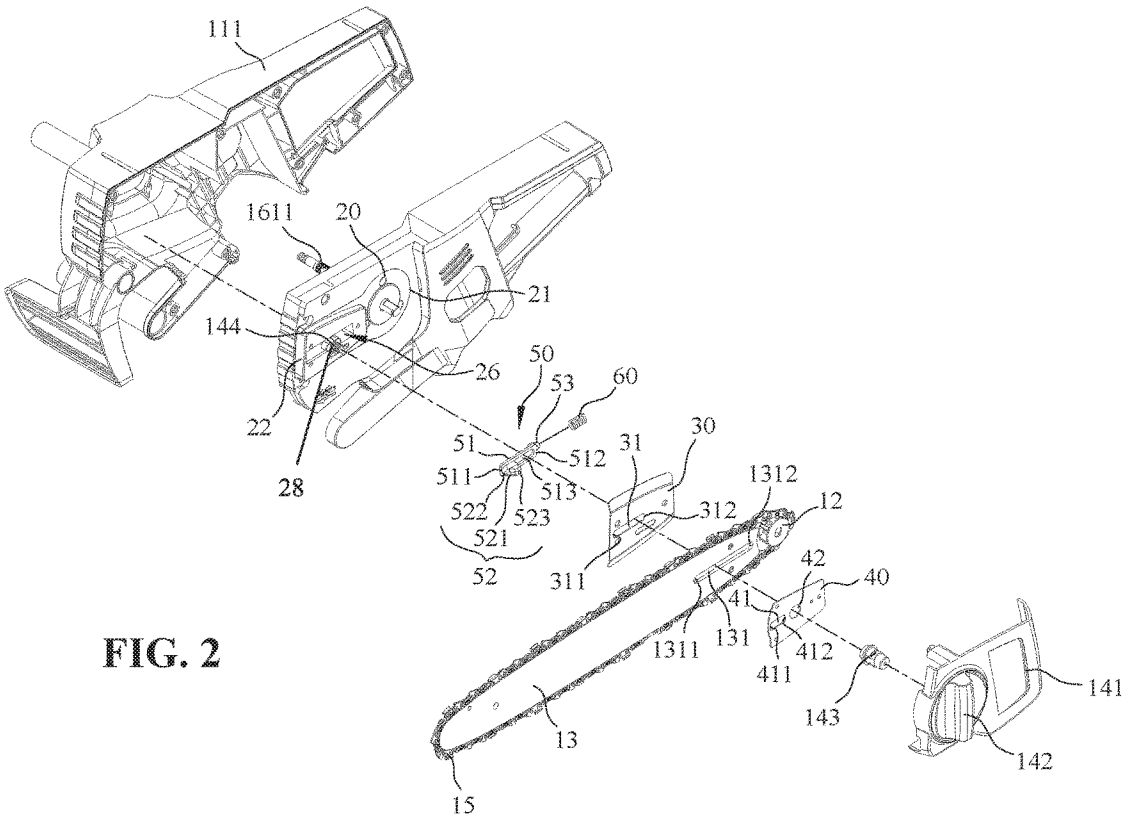
FIG. 2 shows an exploded view of the chain saw with tool-free chain tension adjustment mechanism of the present invention.
Figure 3:
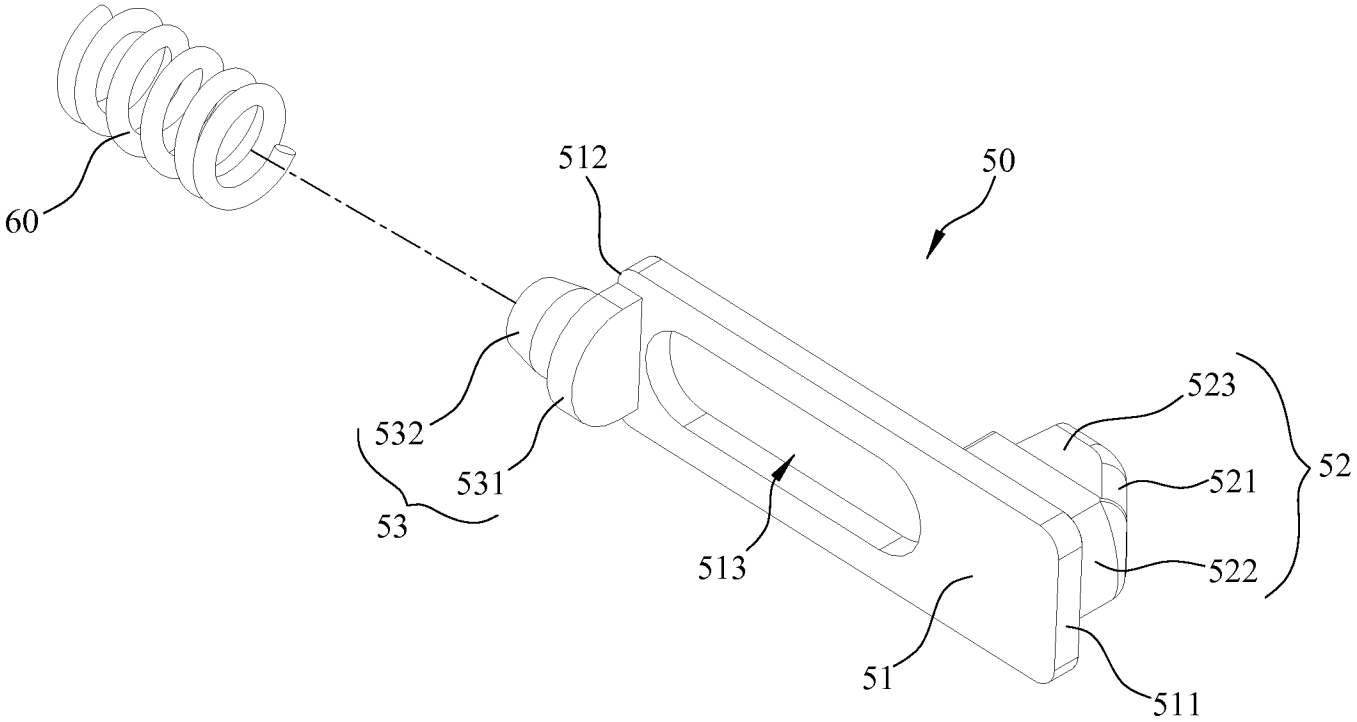
FIG. 3 shows perspective view of a slide element and a biasing member employed in the chain saw with tool-free chain tension adjustment mechanism of the present invention.
Figure 4:
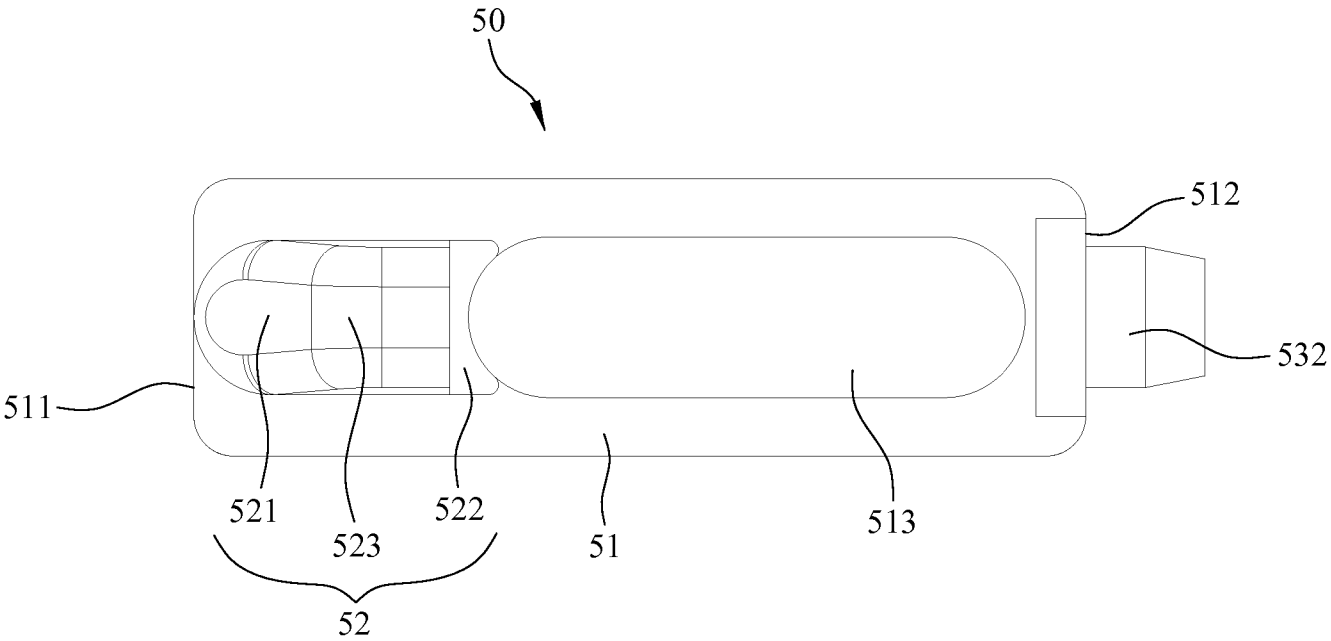
FIG. 4 shows a lateral side view of the slide element shown in FIG. 3.

Referring to FIGS. 1 to 4, wherein FIG. 1 shows a perspective view of a chain saw with tool-free chain tension adjustment mechanism of the present invention; FIG. 2 shows an exploded view of the chain saw with tool-free chain tension adjustment mechanism of the present invention; FIG. 3 shows perspective view of a slide element and a biasing member employed in the chain saw with tool-free chain tension adjustment mechanism of the present invention; and FIG. 4 shows a lateral side view of the slide element shown in FIG. 3. As shown, a chain saw 10 with tool-free chain tension adjustment mechanism of the present invention includes a saw casing 11 constituted by a first half casing 111 and a second half casing 112, a sprocket wheel 12 and a chain plate 13 exposed to an exterior of the second half casing 112 away from the first half casing 111, a saw chain 15 trained over the wheel 12 and the chain plate 13, and a driving device disposed in the saw casing 11 for driving the sprocket wheel 12, thereby rotating the saw chain 15 around an outer periphery of the chain plate 13. The chain plate 13 is generally oval-shaped and is formed with an elongated slot 131 having a first end 1311 distal from the wheel 12 and a second end 1312 proximate to the wheel 12. The chain saw 10 of the present invention further includes a driving device (not numbered), a rotary knob unit (not numbered), a locking member 144 and a tool-free chain tension adjustment mechanism. The rotary knob unit includes a protection cover 141 mounted on an exterior of the second casing half 112 so as to partially covered the chain plate 13 and the wheel 12, a rotary knob 142 mounted on and exposed to an exterior of the protection cover 141 and a locking nut 143 disposed interior of the protection cover 141, the purpose of which will be given the following. The tool-free chain tension adjustment mechanism includes a shielding cover 20, a first partition 30, a second partition 40, a slide element 50 and a biasing member 60, a detailed connection relation among these elements will be explained in the following paragraphs.

The shielding cover 20 is disposed between the saw casing 11 and the chain plate 13. To be more specific, the exterior surface of the second half casing 112 is formed with a chamber complementing with the shielding cover 20 to receive the same securely therein such that the shielding cover 20 is sandwiched securely between the second half casing 112 and the chain plate 13. The shielding cover 20 extends parallel to the chain plate 13, has an axle hole formed adjacent to a first end 21 thereof. The driving device includes a motor having a driving axle 1611 (see FIG. 2) extending through the axle hole in the shielding cover 20 for connecting and driving the wheel 12. Since the axle hole in the shielding cover 20 has a cross section greater than a diameter of the driving axle 1611, rotation of the driving axle 1611 is not hindered. The shielding cover 20 is further formed with a reception chamber 26 for receiving the slide element 50 movably therein and an insert hole 28 which is not spatially communicated with the reception chamber 26 and which is proximate to a second end 22 of the shielding cover 20. The reception chamber 26 has a first end proximate to the wheel 12 and a second end distal from the wheel 12. The locking member 144 includes a head sandwiched securely between the second half casing 112 and the shielding cover 20, and a threaded shaft extending through the insert hole 28 in the shielding cover 20, an elongated slot 513 in the slide element 50 and the elongated slot 131 in the chain plate 13 to fasten threadedly with the locking nut 143, thereby preventing untimely disengagement of the saw plate 13 relative to the saw casing 11.

The first partition 30 is sandwiched between the chain plate 13 and the slide element 50. The first partition 30 is formed with a first partition slot 31 in alignment with the elongated slot 131 of the chain plate 13. The first partition slot 31 has a first end 311 corresponding to the first end 1311 of the elongated slot 131 and a second end 132 corresponding to the second end 1312 of the elongated slot 131.

The second partition 40 is disposed exterior of the chain plate 13 away from the shielding cover 20, thereby sandwiching the chain plate 13 between the first and second partitions 30, 40. The second partition 40 is formed with a second partition slot 41 and a screw hole 42 in non-spatially communication with the second partition slot 41, but respectively aligned with the elongated slot 131 in the chain plate 13. The second partition slot 41 has a first end 411 corresponding to the first end 1311 of the elongated slot 131 and a second end 412 corresponding to the second end 1312 of the elongated slot 131.

The slide element 50 is sandwiched movably between the shielding cover 20 and the first partition 30, has a protrusion 52 extending through the slot 131 in the chain plate 13, the first and second partition slots 31, 41 in the first and second partitions 30, 40. The slide element 50 includes a slide base 51 having a first end 511 distal from to the sprocket wheel 12 and a second end 512 proximate to the sprocket wheel 12 such that the protrusion 52 projects laterally from the slide base 51 adjacent to the first end 511 of the slide base 51. The slide base 51 is formed with an elongated slot 513 with a protrusion seat 522 being disposed between the first end 511 of the slide base 51 and the elongated slot 513, which is generally oval-shaped from a lateral view. The threaded shaft of the locking member 144 extends through the insert hole 28 in the shielding cover 20, the elongated slot 513 in the slide element 50 and the first partition slot 31 in the first partition 30, the elongated slot 131 in the chain plate 13 and the screw hole 42 in the second partition 40 to fasten threadedly with the locking nut 143 so as to prevent untimely disengagement of the saw plate 13 relative to the saw casing 11. It is to note that each of the elongated slot 513 in the slide element 50, the first partition slot 31 in the first partition 30, the elongated slot 131 in the chain plate 13 and the second partition slot 41 in the second partition 40 has a longitudinal length greater than a longitudinal length of the protrusion 52 so as to permit sliding action of the protrusion 52 within the slots 513, 31, 131, 41. The protrusion 52 has an inclined face 521 inclined with respect to the slide base 51 proximate to the first end 511 of the slide base 51.The protrusion 52 further includes a protrusion seat 522 formed on a lateral side surface of the slide base 51 and a guiding projection 523 projecting laterally from the protrusion seat 522 tapering toward a lateral side surface of the chain plate 13. In other words, the guiding projection 523 has the greatest cross section adjacent to the protrusion seat 522. The inclined face 521 is located on the guiding projection 523 proximate to the first end 511 of the slide base 51. In this embodiment, the protrusion seat 522 has a first end parallel to and flush with the first end 511 of the slide base 51 (see FIG. 4). Preferably, the protrusion seat 522 is disposed between the first end 511 of the slide base 51 and the elongated slot 513. To be more specific, the protrusion seat 522 has a second curved end proximate to the second end 512 of the slide base 51 and flushed with a first curved end of the elongated slot 513 proximate to the first end of the slide base 51 (see FIG. 4). The slide element 50 further has a positioning lug 53 projecting outwardly from the slide base 51 adjacent to the second end 512. The positioning lug 53 preferably includes an abutment stud 531 projecting laterally and outwardly from the second end 512 of the slide base 51 and a projection 532 projecting outwardly from the abutment stud 531 generally parallel a longitudinal length of the slide base 51.

The biasing member 60 is disposed in the reception chamber 26 in the shielding cover 20, has a first end sleeved around the projection 532 of the slide base 51 and biasing against the abutment stud 531 and a second end biasing against the second end of the reception chamber 26 in the shielding cover 20, thereby moving the slide element 50 to move away from the wheel 12 and disposing the saw chain 15 under tension between the chain plate 13 and the wheel 12. In this embodiment, a compression spring serves as the biasing member 60.

Referring again to FIG. 2, for installation of the tool-free chain tension adjustment mechanism of the present invention, the shielding cover 20 is mounted securely within the chamber formed in the second half casing 112 away from the first half casing 111 while the head of the locking member 144 is sandwiched securely between the shielding cover 20 and the second half casing 112 such that the threaded shaft of the locking member 144 extends through the insert hole 28 in the shielding cover 20, the elongated slot 513 in the slide element 50, the first partition slot 31 in the first partition 30, the elongated slot 131 in the chain plate 13 and the screw hole 42 in the second partition 40 to fasten threadedly with the locking nut 143, thereby preventing untimely disengagement of the saw plate 13 relative to the saw casing 11. At this time, the driving axle 1611 of the motor extends through the axle hole in the shielding cover 20 and is fastened securely to the sprocket wheel 12 for driving the same. Note that since the positioning lug 53 of the slide base 51 extends into the reception chamber 26 such that the first end of the biasing member 60 is sleeved around the projection 532 for biasing against the positioning lug 53, thereby disposing the first end 311 of the first partition slot 31 in the first partition 30 around the inclined face 521 on the guiding projection 523 of the protrusion seat 522. Also note that the first end 1311 of the elongated slot 131 in the chain plate 13 and the first end 411 of the second partition slot 41 in the second partition 40 are sleeved around the inclined face 521 on the guiding projection 523 of the protrusion seat 522 at the same time. The rotary knob unit includes a protection cover 141 mounted on an exterior of the second casing half 112 so as to partially covered the chain plate 13, the wheel 12 and the second partition 40, and a rotary knob 142 mounted on and exposed to an exterior of the protection cover 141 and fastened securely to the second half casing 112, thereby mounted the protection cover 141 on the second half casing 112.

Figure 5:
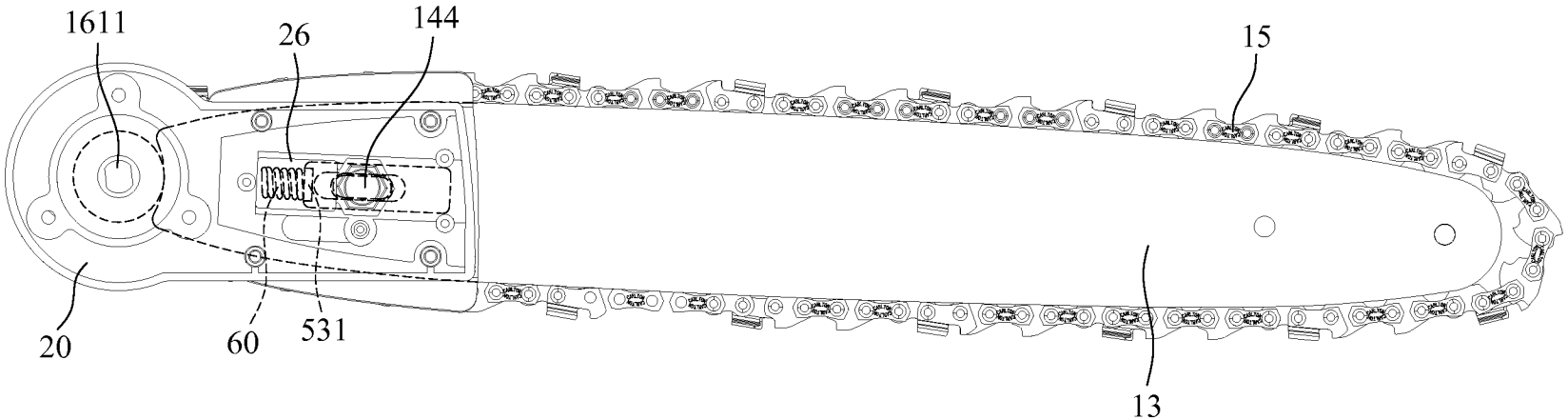
FIG. 5 shows the chain saw of the present invention, illustrating a state in which a chain plate is activated against biasing action of the biasing member in order to release a saw chain trained around the chain plate.
Figure 6:
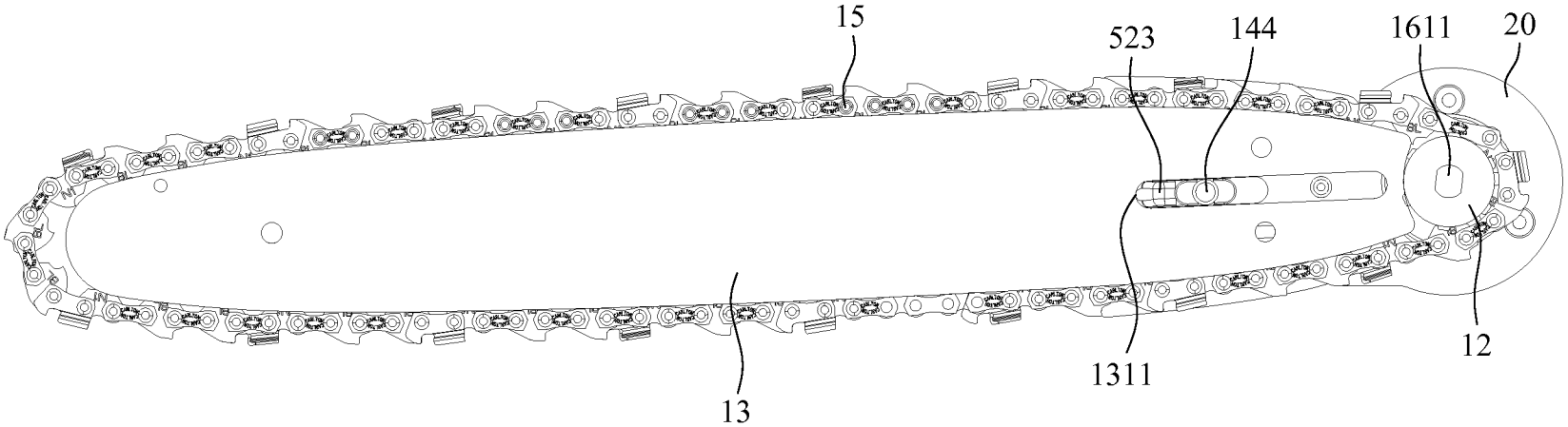
FIG. 6 shows the chain saw of the present invention in a different angle, illustrating a state in which a chain plate is activated against biasing action of the biasing member in order to release a saw chain trained around the chain plate.
Figure 7:
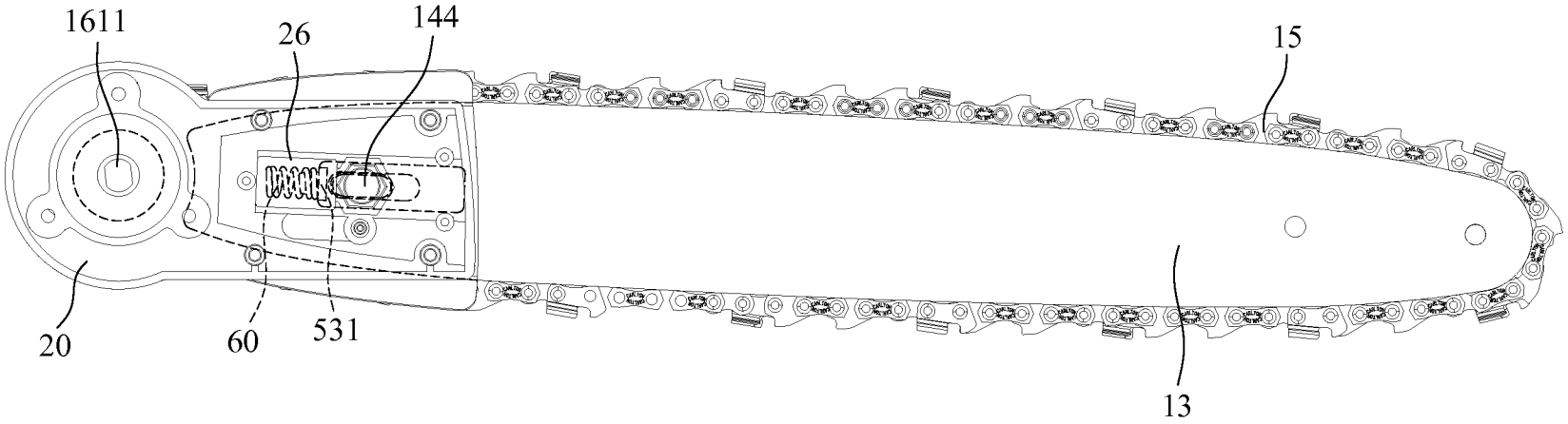
FIG. 7 shows the chain saw of the present invention, illustrating a state in which a saw chain trained around a chain plate under tension.
Figure 8:
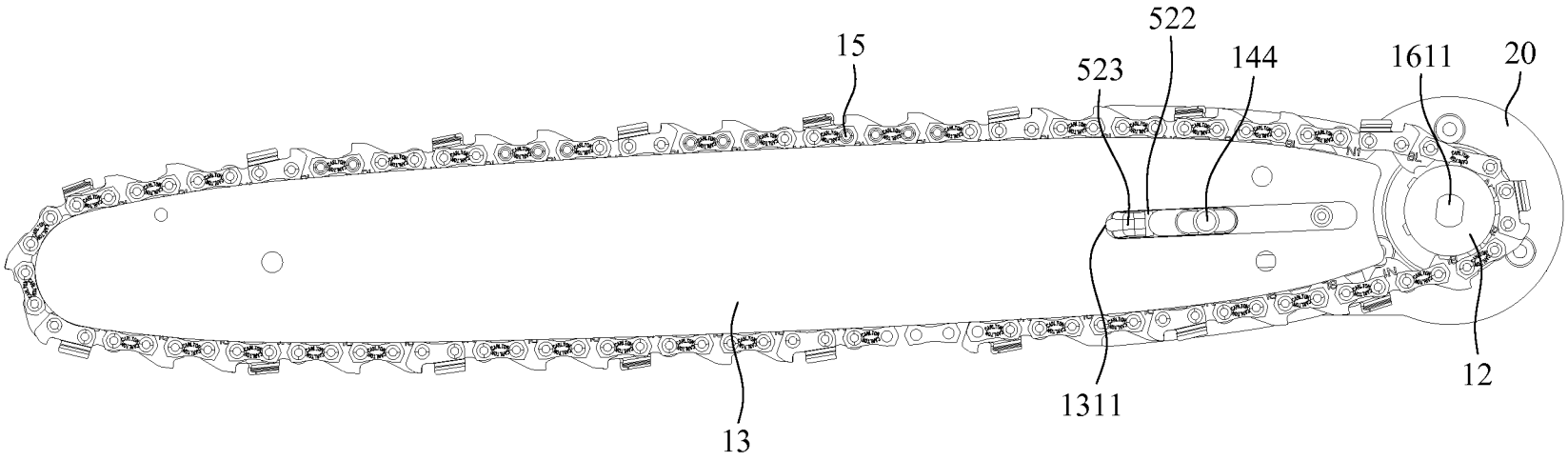
FIG. 8 shows the chain saw of the present invention in a different angle, illustrating a state in which a saw chain trained around a chain plate under tension.

Referring to FIGS. 5 and 6, wherein FIG. 5 shows the chain saw of the present invention, illustrating a state in which the chain plate 13 is activated against biasing action of the biasing member 60 in order to release the saw chain 15 trained around the chain plate 13; and FIG. 6 shows the chain saw of the present invention in a different angle, illustrating a state in which the chain plate 13 is activated against biasing action of the biasing member 60 in order to release the saw chain 15 trained around the chain plate 13. Under this condition, in case the user wishes to release the saw chain 15 from the chain plate 13, movement of the chain plate 13 toward the sprocket wheel 12 against biasing action of the biasing member 60 results in abutment of the first end 1311 of the elongated slot 131 in the chain plate 13 against the protrusion 52 of the slide element 50, which, in turn, results in retraction of the biasing member 60 from its initial shape by the abutment stud 531 in the slide base 51 and pressing the slide element 50 toward the sprocket wheel 12 such that the protrusion 52 of the slide base 51 slides along the first and second partition slots 31, 41 in the first and second partitions 30, 40, thereby releasing the saw chain 15 from the chain plate 13 and the sprocket wheel 12 and vice versa. Referring again to FIGS. 7 and 8, wherein FIG. 7 shows the chain saw 10 of the present invention, illustrating a state in which the saw chain 15 trained around the chain plate 13 and the wheel 12 under tension; and FIG. 8 shows the chain saw 10 of the present invention in a different angle, illustrating a state in which the saw chain 15 trained around the chain plate 13 and the wheel 12 under tension. In case, the user wishes to adjust or place the saw chain 15 under tension for application, he only needs to remove the force of pushing the chain plate 13 against biasing action of the biasing member 60 toward the wheel 12. At this time, the protrusion 52 of the slide base 51 is biased by the biasing member 60 so as to push the slide element 50 away from the wheel 12 such that the protrusion 52 of the slide base 51 slides along the first and second partition slots 31, 41 in the first and second partitions 30, 40 so as to abut resiliently against the first end 1311 of the elongated slot 131 in the chain plate 13, thereby pushing the chain plate 13 away from the wheel 12 and disposing the chain 15 under tension between the chain plate 13 and the wheel 12.

One distinct feature of the present invention resides in that owing to the first end of the biasing member 60 biasing against the abutment stud 531 in the positioning lug 53 of the slide element 50 and further interactively abutment between the protrusion 52 of the protrusion seat 522 and the first end 1311 of the elongated slot 131 in the chain plate 13, the user of the chain saw of the present invention can easily manipulate the chain plate 13 against the biasing action of the biasing member 60 and vice versa.

Another distinct feature of the present invention resides in that the inclined face 521 on the protrusion 52 of the slide base 51 facilitates smooth movement of the first and second partitions 30, 40 and the chain plate 13 to their respective initial positions during the assembly of the tool-free chain tension adjustment mechanism of the present invention in the chain saw, thereby economizing the human labor or shortening the assembly time.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A tool-free chain tension adjustment mechanism for a chain saw, which includes a saw casing, a sprocket wheel, a chain plate exposed to an exterior of the casing, a saw chain trained over the wheel and the chain plate, and a driving device disposed in the saw casing for driving the sprocket wheel, thereby rotating the saw chain around an outer periphery of the chain plate, the chain plate being formed with an elongated slot having a first end distal from the wheel and a second end proximate to the wheel, the chain tension adjustment mechanism comprising:

a shielding cover disposed between the saw casing and the chain plate;

a slide element disposed movably between the chain plate and the shielding cover, the slide element having a slide base having a first end distal from the sprocket wheel and a second end proximate to the sprocket wheel, and a protrusion extending through the slot in the chain plate so as to prevent untimely disengagement of the chain plate relative to the slide element and the shielding cover, the protrusion projecting laterally from said slide base adjacent to the first end of the slide base, the protrusion having an inclined face inclined with respect to the slide base, the inclined face being proximate to the first end of the slide base, the protrusion including a protrusion seat formed on a lateral side surface of the slide base, and a guiding projection projecting laterally from the protrusion seat to taper toward a lateral side surface of the chain plate, the inclined face being located on the guiding projection proximate to the first end of the slide base; and a biasing member having a first end biased against the slide element, and a second end biased against the shielding cover so as to push the slide element away from the wheel, so that the protrusion of the slide element abuts against the first end of the slot in the chain plate and the saw chain is under tension between the chain plate and the wheel, wherein, movement of the chain plate toward the sprocket wheel against a biasing action of the biasing member results in retraction of the biasing member from its initial shape and pressing the slide element toward the sprocket wheel, thereby releasing the saw chain from the chain plate and the sprocket wheel and vice versa.

2. The chain tension adjustment mechanism according to claim 1, wherein the protrusion seat has a first end parallel to the first end of the slide base.

3. The chain tension adjustment mechanism according to claim 2, wherein the first end of the protrusion seat and the first end of the slide base are flush with each other.

4. The chain tension adjustment mechanism according to claim 1, wherein the slide base is formed with an elongated slot with the protrusion seat being disposed between the first end of the slide base and the elongated slot in the slide base.

5. The chain tension adjustment mechanism according to claim 4, wherein the elongated slot in the slide base is generally oval-shaped and has a first curved end proximate to the first end of the slide base, said protrusion seat having a second curved end flush with the first curved end of the elongated slot in the slide base.

6. The chain tension adjustment mechanism according to claim 1, wherein the protrusion seat is located proximate to the first end of the elongated slot in the chain plate.

7. The chain tension adjustment mechanism according to claim 1, further comprising a first partition sandwiched between the chain plate and the slide element, the first partition being formed with a first partition slot permitting extension of the protrusion of the slide element, the first partition slot having a longitudinal length greater than a longitudinal length of the protrusion so as to permit sliding action of the protrusion within the first partition slot.

8. The chain tension adjustment mechanism according to claim 1, wherein the slide element further has a positioning lug projecting outwardly from the slide base adjacent to the second end of the slide base, the first end of the biasing member biasing against the positioning lug.

9. The chain tension adjustment mechanism according to claim 8, wherein the positioning lug includes an abutment stud projecting laterally and outwardly from the second end of the slide base, and a projection projecting outwardly from the abutment stud generally parallel a longitudinal length of the slide base, the first end of the biasing member sleeved around the projection and biased against the abutment stud.

10. The chain tension adjustment mechanism according to claim 9, wherein the shielding cover is formed with a reception chamber for receiving the slide element movably therein, the reception chamber having a first end distal from the wheel and a second end to proximate to the wheel, and the biasing member being disposed in the reception chamber with the first end of the biasing member sleeved around the projection and biased against the abutment stud while the second end of the biasing member being biased against the second end of the reception chamber, thereby moving the slide element away from the wheel.

11. The chain tension adjustment mechanism according to claim 10, wherein the shielding cover has a first side surface that faces the chain plate and that is formed with the reception chamber and a second side surface opposite to the first side surface formed with an insert hole.

12. The chain tension adjustment mechanism according to claim 11, further comprising a wall around the insert hole, and wherein the insert hole in the second side surface of the shielding cover and the reception chamber in the first side surface of the shielding cover are separated by the wall.

13. The chain tension adjustment mechanism according to claim 11, wherein, the shielding cover extends parallel to the chain plate, has a first end formed with an axle hole, the driving device including a motor having a driving axle extending through the axle hole in the shielding cover for connecting to and driving the wheel, the reception chamber being located proximate to the axle hole when compared to the insert hole.

14. A tool-free chain tension adjustment mechanism for a chain saw, which includes a saw casing, a sprocket wheel, a chain plate exposed to an exterior of the casing, a saw chain trained over the wheel and the chain plate, and a driving device disposed in the saw casing for driving the sprocket wheel, thereby rotating the saw chain around an outer periphery of the chain plate, the chain plate being formed with an elongated slot having a first end distal from the wheel and a second end proximate to the wheel, the chain tension adjustment mechanism comprising:

a shielding cover disposed between the saw casing and the chain plate;

a slide element disposed movably between the chain plate and the shielding cover, the slide element having a slide base having a first end distal from the sprocket wheel and a second end proximate to the sprocket wheel, a protrusion extending through the slot in the chain plate so as to prevent untimely disengagement of the chain plate relative to the slide element and the shielding cover, the protrusion projecting laterally from said slide base adjacent to the first end of the slide base, the protrusion having an inclined face inclined with respect to the slide base, the inclined face proximate to the first end of the slide base;

a biasing member having a first end biased against the slide element, and a second end biased against the shielding cover so as to push the slide element away from the wheel, so that the protrusion of the slide element abuts against the first end of the slot in the chain plate and the saw chain is under tension between the chain plate and the wheel; and a first partition sandwiched between the chain plate and the slide element, the first partition being formed with a first partition slot permitting extension of the protrusion of the slide element, the first partition slot having a longitudinal length greater than a longitudinal length of the protrusion so as to permit sliding action of the protrusion within the first partition slot, wherein, movement of the chain plate toward the sprocket wheel against a biasing action of the biasing member results in retraction of the biasing member from its initial shape and pressing the slide element toward the sprocket wheel, thereby releasing the saw chain from the chain plate and the sprocket wheel and vice versa, wherein the shielding cover is formed with an insert hole, the slide base being formed with an elongated slot, the chain saw further includes a rotary knob unit and a locking member, the rotary knob unit including a protection cover mounted on the saw casing so as to partially cover the chain plate and the wheel, a rotary knob mounted on the protection cover and exposed to an exterior of the protection cover, and a locking nut disposed interior of the protection cover, the locking member including a head sandwiched securely between the shielding cover and the saw casing, and a threaded shaft extending through the insert hole in the shielding cover, the elongated slot in the slide base, the first partition slot in the first partition and the elongated slot in the chain plate to fasten threadedly with the locking nut, thereby preventing untimely disengagement of the saw plate relative to the saw casing.

15. A tool-free chain tension adjustment mechanism for a chain saw, which includes a saw casing, a sprocket wheel, a chain plate exposed to an exterior of the casing, a saw chain trained over the wheel and the chain plate, and a driving device disposed in the saw casing for driving the sprocket wheel, thereby rotating the saw chain around an outer periphery of the chain plate, the chain plate being formed with an elongated slot having a first end distal from the wheel and a second end proximate to the wheel, the chain tension adjustment mechanism comprising:

a shielding cover disposed between the saw casing and the chain plate;

a slide element disposed movably between the chain plate and the shielding cover, the slide element having a slide base having a first end distal from the sprocket wheel and a second end proximate to the sprocket wheel, and a protrusion extending through the slot in the chain plate so as to prevent untimely disengagement of the chain plate relative to the slide element and the shielding cover, the protrusion projecting laterally from said slide base adjacent to the first end of the slide base, the protrusion having an inclined face inclined with respect to the slide base, the inclined face being proximate to the first end of the slide base;

a biasing member having a first end biased against the slide element, and a second end biased against the shielding cover so as to push the slide element away from the wheel, so that the protrusion of the slide element abuts against the first end of the slot in the chain plate and the saw chain is under tension between the chain plate and the wheel; and a second partition disposed exterior of the chain plate away from the shielding cover, thereby sandwiching the chain plate between the second partition and the sliding element, the second partition being formed with a second partition slot permitting extension of the protrusion of the slide element, the second partition slot having a longitudinal length greater than a longitudinal length of the protrusion so as to permit sliding action of the protrusion within the second partition slot, wherein, movement of the chain plate toward the sprocket wheel against a biasing action of the biasing member results in retraction of the biasing member from its initial shape and pressing the slide element toward the sprocket wheel, thereby releasing the saw chain from the chain plate and the sprocket wheel and vice versa.

16. The chain tension adjustment mechanism according to claim 15, wherein the shielding cover is formed with an insert hole, the slide base being formed with an elongated slot, the second partition being formed with a screw hole, the chain saw further includes a rotary knob unit and a locking member, the rotary knob unit including a protection cover mounted on the saw casing so as to partially cover the chain plate and the wheel, a rotary knob mounted on the protection cover and exposed to an exterior of the protection cover, and a locking nut disposed interior of the protection cover, the locking member including a head sandwiched securely between the shielding cover and the saw casing, and a threaded shaft extending through the insert hole in the shielding cover, the elongated slot in the slide base, the screw hole in the second partition and the elongated slot in the chain plate to fasten threadedly with the locking nut, thereby preventing untimely disengagement of the saw plate relative to the saw casing.

* * * * *